United States Patent [19]

Fuchs

[11] Patent Number: 4,730,451

[45] Date of Patent: Mar. 15, 1988

[54] METHOD FOR PRODUCING A YARN

[75] Inventor: Helmut Fuchs, Linz, Austria

[73] Assignee: Textilmaschinenfabrik Dr. Ernest Fehrer Aktiengesellschaft, Leonding, Austria

[21] Appl. No.: 930,367

[22] PCT Filed: Mar. 10, 1986

[86] PCT No.: PCT/AT86/00021

§ 371 Date: Oct. 31, 1986

§ 102(e) Date: Oct. 31, 1986

[87] PCT Pub. No.: WO86/05527

PCT Pub. Date: Sep. 25, 1986

[30] Foreign Application Priority Data

Mar. 18, 1985 [AT] Austria ..... 791/85

[51] Int. Cl.[4] ..... D01H 7/892; D01H 7/882

[52] U.S. Cl. ..... 57/401; 57/408; 57/411

[58] Field of Search ..... 57/327, 401, 408, 409, 57/411

[56] References Cited

U.S. PATENT DOCUMENTS 4,570,434 2/1986 Stahlecker ..... 57/401

4,601,167 7/1986 Fuchs ..... 57/401

4,606,187 8/1986 Stahlecker ..... 57/401

4,607,485 8/1986 Stahlecker ..... 57/401

*Primary Examiner*—Donald Watkins

*Attorney, Agent, or Firm*—Kurt Kelman

[57] ABSTRACT

Apparatus for making a yarn comprises two juxtaposed, closely spaced apart twisting drums (1), which are adapted to be driven in the same sense, and an inclined fiber-guiding duct (4), which succeeds fiber-opening means (3) and protrudes into the generally triangular twisting space (2) between the two twisting drums (1) and serves to supply singled fibers in an entraining air stream to the generally triangular twisting space (2).

In order to ensure a supply of properly oriented and uniformly distributed fibers into the generally triangular twisting space (2), the length (L) of the shortest boundary wall (5) of the fiber-guiding duct (4), which wall faces the generally triangular twisting space (2), is at least as large as the average length of the longest fibers to be processed in the apparatus, the ratio of the length (1) to the width (*b*) of the flow area is between 10:1 and 2:1, and the entraining air stream has a mean velocity of flow corresponding to a Reynolds number of 5,000 to 50,000.

1 Claim, 2 Drawing Figures

METHOD FOR PRODUCING A YARN

Figure 1:
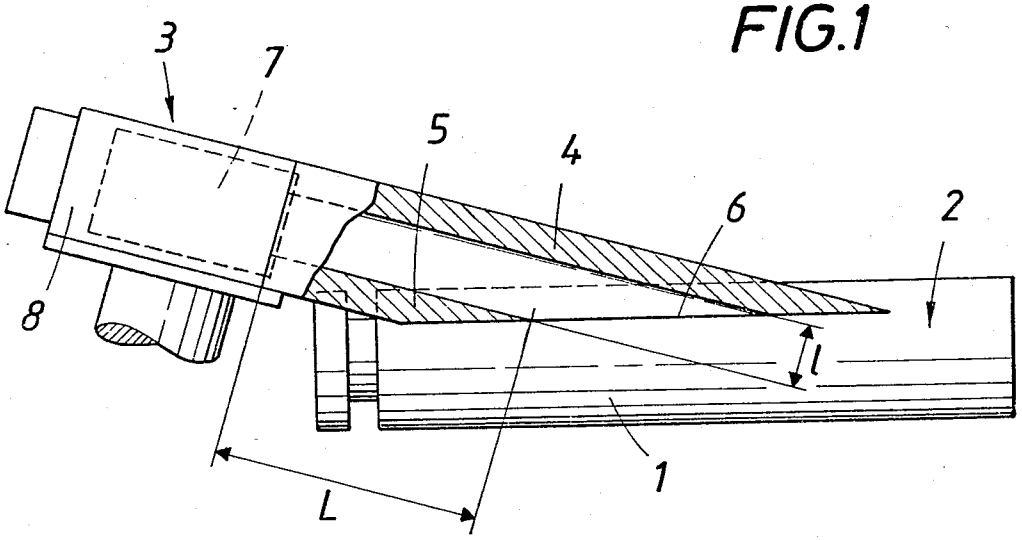

This invention relates to apparatus for making a yarn, comprising two juxtaposed, closely spaced apart twisting drums, which are adapted to be driven in the same sense and define between them a generally triangular twisting space, and an inclined fiber-guiding duct, which communicates with fiber-opening means and protrudes into the generally triangular twisting space between the twisting drums and serves to supply singled fibers in an entraining air stream into the generally triangular twisting space.

When fibers supplied through a fiber-guiding duct into a generally triangular twisting space between two twisting drums rotating in the same sense are twisted together in said generally triangular twisting space to form a yarn, or when covering fibers supplied into the generally triangular twisting space are wound in said space around a drawn roving which is pulled through the generally triangular twisting space, the strength and uniformity of the resulting yarn will essentially depend on a uniform and directed supply of the fibers into the generally triangular twisting space. The fibers which have been singled by preceding fiber-opening means should be substantially parallel and uniformly distributed as they are supplied to the generally triangular twisting space so that irregularities will not occur in the resulting yarn as a result of a random orientation and irregular distribution of the fibers. Said requirements cannot be met, particularly if the single fibers delivered in an entraining air stream tend to form lumps as they travel through the fiberguiding duct.

For this reason it is an object of the invention so to improve by the use of simple means a yarn-making apparatus of the kind described first hereinbefore that a directed and uniform supply of fibers into the generally triangular twisting space will be ensured without a risk of a formation of lumps.

The object set forth is accomplished in accordance with the invention by entraining the singled fibers in an air stream having a mean velocity of flow corresponding to a Reynolds number of 5,000 to 50,000 in a shortest boundary wall of the fiber-guiding duct whose shortest boundary wall facing the generally triangular twisting space has a length which is at least as large as the average length of the longest fibers to be processed in the apparatus, the ratio of the length to the width of the flow area of the duct being between 10:1 and 2:1.

Because the minimum length of the shortest boundary wall of the fiber-guiding duct matches the average length of the longest fibers which can be processed by the apparatus, it is ensured that a flow path of adequate length is provided in which the singled fibers entrained by the entraining air stream are oriented in the direction of flow. As a result, the singled fibers which are entrained by the entraining air stream will substantially extend along the flow lines as said fibers enter the generally triangular twisting space. Because the fiber-guiding duct protrudes into the generally triangular twisting space between the two twisting drums, the width of the cross-section of said duct is limited by the open width of the generally triangular twisting space adjacent to the mouth of the fiber-guiding duct. In order to permit a flow of entraining air through the fiber-guiding duct at an adequate rate, on the one hand, and to ensure a desirable extent of the mouth of the fiber-guiding duct in the direction of yarn withdrawal, as is significant for a uniform tying of the supplied fibers into the fibrous structure of the yarn being formed, the flow area of the fiber-guiding duct must have a substantial longitudinal extent. Important requirements for a uniform supply of fibers will be fulfilled if the ratio of the length to the width of the generally rectangular flow area is between 10:1 and 2:1. But in addition to the stated conditions it will be essential to ensure that the entraining air stream will have such a velocity of flow that individual fibers will not fall out of the entraining air stream and that a formation of lumps by collisions of fibers will be prevented. Said requirements can also be satisfactorily fulfilled if the entraining air stream has a mean velocity of flow corresponding to a Reynolds number between 5,000 and 50,000. If the Reynolds number decreases below 5,000, the velocity of fall of the individual fibers will have an appreciable effect so that part of the fibers will fall out of the entraining air stream. Besides, a satisfactory separation of the individual fibers from the fiber-opening means will not be ensured in case of such a low velocity of flow of the entraining air stream. If the mean velocity of flow of the entraining air stream rises to a value corresponding to a Reynolds number in excess of 50,000, the interaction of the individual fibers in the entraining air stream will increase as well as the number of collisions between fibers flying close to each other so that the tendency to form lumps will be increased. It is apparent that the singled fibers can be delivered into the generally triangular twisting space uniformly and in a proper orientation if the boundary walls of the inclined fiber-guiding duct have at least the stated length, the flow area has the stated length-to-width ratio, and the velocity of flow corresponds to the stated range of a Reynolds number in the stated range.

In order to ensure that the frictional resistance between the fibers and the walls of the duct as well as the disturbing influences of the boundary layer at the inside surfaces of the duct will be small, the peak-to-valley height of the inside surfaces of the fiberguiding duct may be smaller than the fiber diameter and may preferably lie between 1 $\mu$m and 15 $\mu$m.

Figure 2:
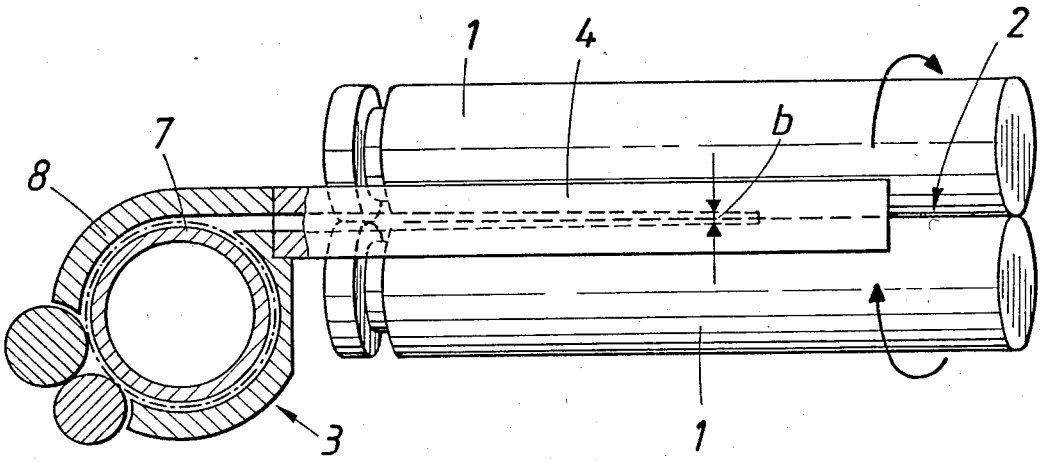

The subject matter of the invention is shown by way of example on the drawing, in which FIG. 1 is a diagrammatic vertical sectional view showing apparatus in accordance with the invention for making a yarn and FIG. 2 is a top plan view showing that apparatus and taken at right angles to the longitudinal direction of the fiber-guiding duct and partly broken away.

The illustrated apparatus for making a yarn essentially consists of two juxtaposed, closely spaced apart twisting drums 1, which are adapted to be driven in the same sense and define between them a generally triangular twisting space 2, to which a vacuum is applied, and a fiber-guiding duct 4, which is connected to fiber-opening means 3 and opens into the generally triangular twisting space 2. The fibers which have been singled in the fiber-opening means 3 are supplied through said fiber-guiding duct 4 into the generally triangular twisting space 2 between the two twisting drums 1 and are twisted together there to form a yarn , which can be withdrawn by yarn-withdrawing means, not shown. Because the individual fibers entering the generally triangular twisting space should be as closely parallel as possible to the direction of yarn withdrawal, the fiber-guiding duct 4 is correspondingly inclined so that the angle between the longitudinal axis of the fiber-guiding duct 4 and the common diametral plane of the two twisting drums 1 can be minimized.

In order to ensure that the fibers will be properly oriented and uniformly distributed as they enter the generally triangular twisting space 2, that boundary wall 5 of the fiber-guiding duct 4 which faces the generally triangular twisting space has a length L which is at least as large as the average length of the longest covering fibers which can be processed by the apparatus and is preferably one and half times to twice the length of said covering fibers. That measure will ensure that the individual fibers which leave the fiber-opening means and are entrained by the entraining air stream will be oriented in the direction of the flow lines of the entraining air stream.

Owing to the open width of the generally triangular twisting space 2 adjacent to the mouth area 6 of the fiber-guiding duct 4 and the requirement for a predetermined minimum mouth area 6 and a corresponding air flow rate, the flow area must be substantially rectangular and must have a ratio of length 1 to width b in the range from 10:1 to 2:1. If said design conditions for the fiber-guiding duct 4 are met and it is ensured that the entraining air stream has such a velocity of flow that a Reynolds number between 5,000 and 50,000 is obtained along the length of the fiber-guiding duct 4, the influence of the velocity of fall, which in case of a low velocity of flow will result in a separation of fibers from the entraining air stream, may be reduced to a permissible value and the tendency to form lumps at a higher velocity of flow can be limited so that directed fibers will be supplied with a high uniformity into the generally triangular twisting space 2.

The definition of a lower limit for the mean velocity of flow of the entraining air stream will also ensure a satisfactory separation of the individual fibers from the fiber-opening means, which in the illustrative embodiment are constituted by a carding drum 7, which has a housing 8, to which the fiber-guiding duct 4 is directly attached. That carding drum 7 might be replaced by drawing rollers for singling the fibers which are to be supplied to the generally triangular twisting space. In that case the fiber-guiding duct 4 will succeed the exit pair of drawing rollers.

In the illustrative embodiment the entraining stream is generated by the suction inserts of the twisting drums 1 because the vacuum applied to the generally triangular twisting space 2 will suck in said space a stream of air, which is effective also in the fiberguiding duct 4 and causes a corresponding stream of entraining air to be injected into said duct. Alternatively, a suitable entraining air stream may be generated by blast nozzles, which may be provided adjacent to the housing 8 for the carding drum 7 or adjacent to the fiber-guiding duct 4 itself. If a blast nozzle which is longitudinally aligned with the fiber-guiding duct 4 is tangentially connected to the housing 8 adjacent to the point where fibers are thrown off the carding drum 7, said blast nozzle may desirably assist the separation of the individual fibers from the carding drum. Such an assistance of the separation of the fibers will also be achieved if the blast nozzle is replaced by an air intake opening, through which air is sucked owing to the injector action of the suction zones of the twisting drums 1.

What I claim is:

1. A method of making a yarn in an apparatus comprising two juxtaposed, closely spaced twisting drums adapted to be driven in the same sense and defining a generally triangular twisting space therebetween, a fiber-opening means, and an inclined fiber-guiding duct receiving singled fibers from the fiber-opening means and protruding into the twisting space for supplying the singled fibers thereto, the length of the shortest boundary wall of the fiber-guiding duct facing the twisting space being at least equal to the average length of the longest singled fibers and the duct defining a flow area whose length-to-width ratio is between 10:1 and 2:1, which comprises the step of entraining the single fibers through the duct into the twisting space in an air stream having a mean velocity of flow corresponding to a Reynolds number of 5,000 to 50,000.

* * * * *